US005509540A

United States Patent [19]

Pomerantz

[11] Patent Number: 5,509,540

[45] Date of Patent: Apr. 23, 1996

[54] DISPLAY HOLDER FOR BALLOONS, FLOWERS OR THE LIKE

[76] Inventor: Carl Pomerantz, 567 Lakeshore Blvd., Beaconsfield, Montreal Que., Canada, H9W 4K3

[21] Appl. No.: 310,328

[22] Filed: Sep. 22, 1994

[51] Int. Cl.[6] ..... A47F 7/00

[52] U.S. Cl. ..... 211/13; 211/87; 211/60.1; 248/205.3; 248/314; 446/222

[58] Field of Search ..... 211/13, 60.1, 69.1, 211/87; 47/87, 41.01, 41.13; 446/222; 248/205.3, 314

[56] References Cited

U.S. PATENT DOCUMENTS

| | | | |
|---|---|---|---|
| 496,013 | 4/1893 | Snow, Jr. | 211/60.1 X |
| 2,550,023 | 4/1951 | Reilly | 248/314 X |
| 3,176,662 | 4/1965 | Williams | 211/60.1 X |
| 3,431,041 | 3/1969 | Fontlladosa | 211/60.12 |
| 3,745,702 | 7/1973 | Ogawa | 211/60.1 X |
| 4,294,365 | 10/1981 | Henderson | 211/60.1 |
| 5,025,934 | 6/1991 | Vogel | 211/60.1 X |
| 5,127,189 | 7/1992 | Holmberg | 47/87 |
| 5,232,103 | 8/1993 | Koenig et al. | 211/60.1 |

*Primary Examiner*—Robert W. Gibson, Jr.
*Attorney, Agent, or Firm*—Mila Shvartsman

[57] ABSTRACT

The present invention relates to a holder for balloons, flowers or the like on sticks, comprising a holder element having a mounting surface adapted to be securely attached to a support structure by attachment element located on the mounting surface. At least one receptacle of predetermined depth is adapted to tightly hold a lower portion of the stick by a secure elements located within the receptacle, wherein the secure means adapted to securely hold a stick of various diameters. The mounting surface is adapted to be securely attached to a vertical wall or fixture, and wherein a longitudinal centerline of the receptacle is tilted away from the mounting surface to provide less displacement and reduction of bending moment of an upper end of a stick having a balloon or flower attached, which in turn allows reduction of the peeling force applied to the attachment elements. The angle between the longitudinal centerline of the receptacle and the mounting surface is at least ½ degree. The holder element having a number of receptacles adapted to securely hold a plumage-type arrangements of balloons or flowers. The secure elements is provided by means of tapering of the receptacle downwardly from an entrance towards a bottom portion, wherein the receptacle becomes progressively tighter as the stick is further inserted inside of the receptacle.

20 Claims, 1 Drawing Sheet

DISPLAY HOLDER FOR BALLOONS, FLOWERS OR THE LIKE

The present invention is related to decorative object holders, and more specifically to a holder for displaying baboons or flowers having stems or sticks.

There is known U.S. Pat. No. 4,936,532 for baboon closure and hanger device comprising a closure tab and support tab, said closure tab and support tab being integrally constructed at each end of an angular disposed central portion, said closure tab having slots formed therein for receipt of the stem of an inflated balloon.

There is also known U.S. Pat. No. 4,895,545 related to baboon cup holder and stick in which the cup has a longitudinal slit passing through the sidewall thereof from an open end of the cup to a closed end thereof which is attached to a shaft.

There is known U.S. Pat. No. 5,088,216 related to display holder for cards, flowers and the like comprising a bottom portion for displaying cards and a top portion for holding flowers, said top portion comprises a circular bottom wall and a cylindrical side wall. The bottom wall of the top portion is formed with apertures therethrough for receiving flower stems, baboon sticks, or the like.

In retail stores, balloons are used for promotional display purposes. Once inflated, balloons are often attached to a balloon cup, such as shown in U.S. Pat. No. 4,895,545 which is then attached to a stick usually about two feet long. These balloons and sticks are often sold at retail as well. The effectiveness of the balloon and stick display can be further enhanced by grouping these balloons together in pairs or triplets to accomplish a plumage-type effect. However there has previously been no efficient, cost effective ways to attach or mount the balloon sticks to store fixtures or other vertical or horizontal surfaces for widespread use throughout a store.

Methods for balloon stick display that had been used in the past include messy adhesive tape, elaborate steel tubing receptacles, or expensive, inefficient hand-made wood receptacles. While taping the balloon sticks to store fixtures is a temporary means of mounting the balloon sticks, it is deficient in several respects. First, it is time consuming and expensive for store personnel to tape the baboon sticks to fixtures every time a display is desired. It is also unsightly and detracts from the display. Besides, it s very difficult to group balloons in pairs or triplets and achieve a plumage-type effect. It is also time consuming and therefore expensive to remove the tape when it is required to remove the display. As well, when the tape is removed, there is an adhesive residue on the sticks, thus sticks cannot be easily reused or sold since they look unattractive and dirty. In case if it is desired to retail the balloons and sticks, it is difficult and tedious for a customer to remove taped articles from the fixture, so the shopper is therefore discouraged from purchasing the product.

There have been known elaborate steel tubing structures and wood structures that have been used to accommodate balloon sticks. These structures need to be chrome plated or coated with chrome tapes to give them a chrome-like appearance to match store fixtures. These structures have been very expensive to fabricate, and therefore on the basis of cost, are not suited for widespread use. Besides, they have been functionally lacking in several respects which has precluded their widespread use. They feature oversized holes to accommodate the balloon sticks which vary widely in diameter, so sticks are not firmly anchored in the holders. As a result, balloon sticks fall out of these holders if they are bumped into or touched by passer-by; this ruins the display and creates a costly maintenance problem for store personnel to monitor the display. Furthermore, these structures are not capable of being effectively attached or mounted onto a vertical surface such as store fixtures. As a result of these deficiencies, these structures are not suited for widespread use and are restricted to limited store areas where there is little direct store traffic.

Balloon sticks are manufactured by many manufacturers, therefore there is variation in stick diameter. However, it is extremely important that the sticks be firmly anchored in the display so that they are not knocked onto the floor by a passer-by.

The present invention overcomes this problem by featuring tapered holes or receptacles which get progressively tighter as the stick is further inserted into the hole. Besides, the crosssection in the lower portion of the hole features a wedged portion which serves to further anchor and grip the balloon stick. Since the balloon stick is made of a softer, more malleable material than the holder, this wedge or notch firmly wedges the stick into the holder. Although it is firmly engaged in the holder and will not fall out when accidentally knocked or disturbed laterally, when desired, the stick can quickly be pulled longitudinally out of the holder if firmly gripped. Once removed, the stick is not noticeably damaged or marked by the anchoring means in the holder, and therefore the balloon stick can be used again or, if desired, later sold.

The present invention provides a cost effective means of efficiently holding, displaying and maintaining balloons or other decorative articles on sticks. It can easily be adapted to a wide variety of store display situations. It can feature an adhesive backing for rapid attachment to store fixtures and other vertical or horizontal surfaces, as well as one or more holes or receptacles that are sized and shaped to receive and firmly anchor balloon sticks.

SUMMARY OF THE INVENTION

Broadly, the present invention comprises a holder for balloons, flowers or the like on sticks, comprising:

a holder element having a mounting surface adapted to be securely attached to a support structure by attachment means located on said mounting surface;

at least one receptacle of predetermined depth adapted to tightly hold a lower portion of the stick by a secure means located within said receptacle, wherein said secure means adapted to securely hold said stick of various diameters.

In another embodiment of the present invention, said mounting surface is adapted to be securely attached to a vertical wall or fixture, and wherein a longitudinal centerline of said receptacle is tilted away from said mounting surface to provide less displacement and reduction of bending moment of an upper end of said stick having attached balloon or flower, which in turn allows reduction of the peeling force applied to said attachment means. The angle between the longitudinal centerline of said receptacle and said mounting surface is at least ½ degree.

In yet another embodiment of the present invention, said holder element having a number of said receptacles adapted to securely hold a plumage-type arrangements of said balloons or flowers. Said secure means is provided by means of tapering of said receptacle downwardly from an entrance towards a bottom portion, wherein said receptacle becomes progressively tighter as said stick is further inserted inside of said receptacle. Said receptacle having a shape of an inverted frustrum of right circular cone. The angle of tapering of said receptacle is at least 2 degrees.

In still another embodiment of the present invention, said secure means further comprises an anchor means also located within said receptacle; wherein said anchor means are adapted to additionally firmly grip the lower portion of said stick without damaging the stick. Said anchor means comprises a wedge element integrally formed near a bottom portion of said receptacle. Said attachment means comprises a serf-adhesive means coveting said mounting surface, or said attachment means comprises a magnetic element connected to said mounting surface. Said holder element is made of plastic resin, such as styrene.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 2:
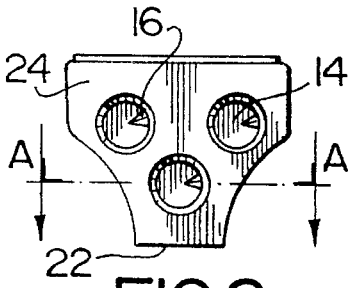
FIG. 2 is a top view of the balloon holder of FIG. 1
Figure 1:
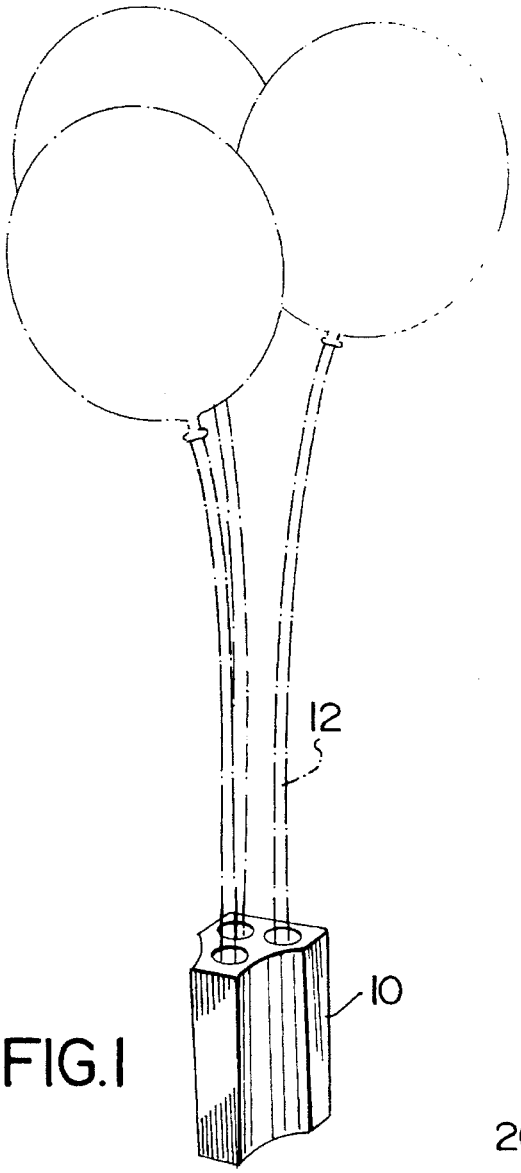
FIG. 1 is a perspective view of the balloon holder according to the present invention in use holding a triplet of balloons on sticks.
Figure 3:
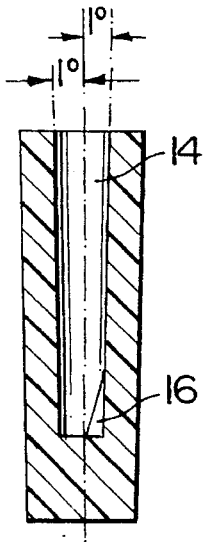
FIG. 3 is a cross-sectional side view of FIG. 2 taken along the lines A—A.
Figure 4:
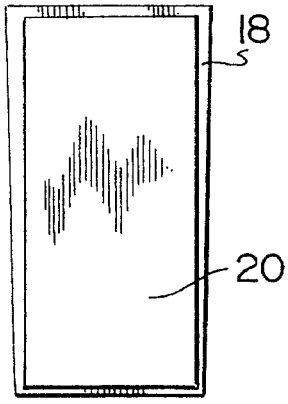
FIG. 4 is a back view showing an attachment means according to the present invention.

Referring now to drawings, FIG. 1 shows a balloon holder 10 having a triplet of balloons attached to sticks 12 in a plumage-type arrangement. FIGS. 2 and 3 show three receptacles or holes 14 of predetermined depth located within the body of the holder 10. Preferably, but not necessarily, each of said receptacles 14 can have a shape of an inverted frustrum of right circular cone. Preferably, the degree of said cone is at least ½ degree, which is dictated by the requirements of production. The fact that those receptacles are tapered downwardly from the entrance towards the bottom allow to securely hold the lower portion of the stick 12 without noticeably damaging it. Thus, tapered configuration of receptacle 14 provides secure means allowing to securely hold stick of any diameter. FIG. 3 shows an anchor means or wedge 16 integrally formed near the bottom portion of each receptacle 14. Said wedge or notch 16 allows to additionally firmly wedge or grip the stick 12 into the holder 10, which will prevent said sticks with attached balloons from falling out when accidently knocked or disturbed laterally. At the same time, the stick 12 can be easily removed out of the holder 10 without noticeable damage and be reused or sold later. FIG. 4 shows a back portion or mounting surface 18 of the holder 10 having an attachment means 20 provided for attachment of said holder 10 to any supporting surface, such as store fixtures, wall or the like. In one embodiment the attachment means 20 comprises a self-stick adhesive with a liner which can be removed for mounting quickly in the store. In the other embodiment said attachment means could be a magnet, so that the holder 10 could be mounted temporarily onto any metallic surface. However, the present invention is not restricted to said embodiment and the holder 10 could fit into an engaging/disengaging device, so that device would be permanently attached to any support surface while the holder itself could be removable.

Figure 7:
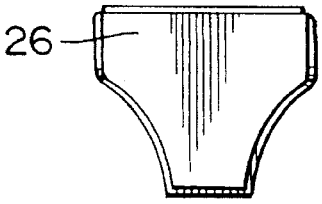
FIG. 7 is a bottom view of the present invention.

In still another embodiment, said attachment means could be located on a bottom portion 26, as shown on FIG. 7, which allows to attach the holder 10 to any horizontal support surface. For example, this arrangement could be particularly advantageous in the car dealer's showroom, in this case using a magnet as the preferred attachment means.

Figure 6:
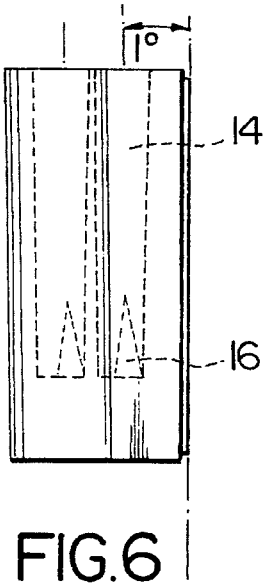
FIG. 6 is left/right side view showing in broken lines the shape of receptacles according to the present invention.

Referring now to FIG. 6, it is shown that the longitudinal center line of each receptacle 14 is tilted away or diverged from the vertical mounting surface 18, at preferably around 1 degree angle. The reason for such an arrangement is as follows: if the mounting surface 18 of the holder 10 is parallel to the longitudinal center line of the receptacle 14, a considerable bending moment is produced by sticks as the balloons create displacement at the end of the sticks 12 by pushing against the vertical surface above the holder. This bending moment translates into a prying effect on the holder 10, which generates peeling forces on the adhesive which over time will weaken and pry the holder off the vertical surface and cause the display to fall down. Due to the presence of a tilted or diverged effect of center lines, when the balloons and sticks are anchored in the holder, there is less displacement at the upper end of the stick reducing the bending moment. As a result, the prying effect and peeling forces are reduced. Thus, the arrangement of the present invention adheres more securely to the vertical wall or surface for a longer period of time. This increased adhesion characteristic of the present invention makes the display less time consuming for personnel to maintain, and therefore is more cost effective for use on a widespread basis.

Figure 5:
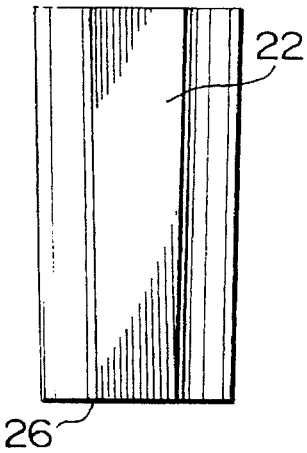
FIG. 5 is a from view of the present invention.

Although many materials and methods of fabrication can be used to manufacture the holder according to the present invention, it is preferred to use the injection moulding method and plastic resins, such as styrene. TIffs method of fabrication is well suited for achieving non-parallel configuration of longitudinal center lines, tapering of receptacles, formation of integral wedges near the bottom of said receptacles and other related features. The final product can be hot-stamped to achieve a chrome-like finish of front portion 22 as shown on FIG. 5. Of course, this finishing is purely decorative, but is very desirable for display in department stores, who are some of the most important users of the present invention.

In contrast, if fabricating a similar product out of wood, it would be much more costly to achieve all those features of the present invention. Similarly, if the product is made by an extrusion process, the cross-sections in this case must remain uniform along the length of the pieces, thus the advantages of the present invention cannot be achieved.

The product according to the present invention can be hot-stamped at a low cost, so that material and production costs are minimized while achieving the desired aesthetic and functional requirements in the final product.

Thus, it can be seen that the objects of the present invention have been satisfied by the structure presented hereinabove. While in accordance with the Patent Statutes, only the best mode and preferred embodiments of the present invention has been presented and described in detail, it is to be understood that the invention is not limited thereto or thereby. Accordingly, for an appreciation of the true scope and breadth of the invention, references should be made to the following claims.

What is claimed is:

1. A holder for balloons, flowers or the like on sticks, comprising:

a holder element having a mounting surface adapted to be securely attached to a vertical support structure by attachment means located on said mounting surface;

at least one receptacle of predetermined depth adapted to tightly hold a lower portion of the stick by a secure means located within said receptacle, said secure means adapted to securely hold said stick of various diameters, wherein said secure means is provided by means of tapering of said receptacle downwardly from an entrance towards a bottom portion, and wherein said receptacle becomes progressively tighter as said stick is further inserted inside of said receptacle;

wherein a longitudinal centerline of said receptacle is tilted away from said mounting surface to provide less displacement and reduction of bending moment of an upper end of said stick having attached balloon or flower, which in turn allows reduction of the peeling force applied to said attachment means.

2. A holder according to claim 1, wherein the angle between the longitudinal centerline of said receptacle and said mounting surface is at least ½ degree.

3. A holder according to claim 1, wherein said holder element having a number of said receptacles adapted to securely hold a plumage-type arrangements of said balloons or flowers.

4. A holder according to claim 1, wherein said receptacle having a shape of an inverted frustrum of right circular cone.

5. A holder according to claim 4, wherein the angle of tapering of said receptacle is at least 2 degrees.

6. A holder according to claim 1, wherein said secure means further comprises an anchor means also located within said receptacle; wherein said anchor means are adapted to additionally firmly grip the lower portion of said stick without damaging the stick.

7. A holder according to claim 6, wherein said holder is one-piece element and wherein said anchor means comprises a wedge element integrally formed near a bottom portion of said receptacle.

8. A holder according to claim 1, wherein said attachment means comprises a self-adhesive means covering said mounting surface.

9. A holder according to claim 1, wherein said attachment means comprises a magnetic element connected to said mounting surface.

10. A holder according to claim 1, wherein said holder element is made of plastic resin, such as styrene.

11. A holder for balloons, flowers or the like on sticks, comprising:

a holder dement having a mounting surface adapted to be securely attached to a vertical support structure by attachment means located on said mounting surface;

at least one receptacle of predetermined depth adapted to tightly hold a lower portion of the stick of various diameter by a secure means located within said receptacle, wherein said secure means is provided by means of tapering of said receptacle downwardly from an entrance towards a bottom portion, wherein said receptacle becomes progressively tighter as said stick is further inserted inside of said receptacle;

and wherein a longitudinal centerline of said receptacle is diverged away from said mounting surface to provide less displacement and reduction of bending moment of an upper end of said stick having attached balloon or flower, which in turn allows reduction of the peeling force applied to said attachment means.

12. A holder according to claim 11, wherein the angle between the longitudinal centerline of said receptacle and said mounting surface is at least ½ degree.

13. A holder according to claim 11, wherein said holder element having a number of said receptacles adapted to securely hold a plumage-type arrangements of said balloons or flowers.

14. A holder according to claim 11, wherein said receptacle having a shape of an inverted frustrum of right circular cone.

15. A holder according to claim 14, wherein the angle of tapering of said receptacle is at least 2 degrees.

16. A holder according to claim 11, wherein said secure means further comprises an anchor means also located within said receptacle; wherein said anchor means are adapted to additionally firmly grip the lower portion of said stick without damaging the stick.

17. A holder according to claim 16, wherein said holder is one-piece element and wherein said anchor means comprises a wedge element integrally formed near a bottom portion of said receptacle.

18. A holder according to claim 11, wherein said attachment means comprises a self-adhesive means covering said mounting surface.

19. A holder according to claim 11, wherein said attachment means comprises a magnetic element connected to said mounting surface.

20. A holder according to claim 11, wherein said holder element is made of plastic resin, such as styrene.

* * * * *